US005494765A

United States Patent [19]

Fukami et al.

[11] Patent Number: 5,494,765

[45] Date of Patent: Feb. 27, 1996

[54] ELECTROPHOTOSENSITIVE MATERIAL USING A PHENYLENEDIAMINE DERIVATIVE

[75] Inventors: Toshiyuki Fukami; Hideo Nakamori; Keisuke Sumida; Sakae Saito, all of Osaka, Japan

[73] Assignee: Mita Industrial Co. Ltd, Osaka, Japan

[21] Appl. No.: 311,925

[22] Filed: Sep. 26, 1994

[30] Foreign Application Priority Data

Oct. 14, 1993 [JP] Japan ..... 5-257206
Oct. 14, 1993 [JP] Japan ..... 5-257208

[51] Int. Cl.[6] ..... G03G 5/09; G03G 5/047

[52] U.S. Cl. ..... 430/59; 430/83

[58] Field of Search ..... 430/59, 83

[56] References Cited

U.S. PATENT DOCUMENTS

| | | | |
|---|---|---|---|
| 3,615,404 | 10/1971 | Price et al. | 430/83 X |
| 3,879,198 | 4/1975 | Saeva et al. | 430/72 X |
| 4,346,159 | 8/1982 | Sadamatsu et al. | 430/66 X |
| 5,087,544 | 2/1992 | Muto et al. | 430/59 X |
| 5,185,228 | 2/1993 | Maeda et al. | 430/59 |
| 5,213,926 | 5/1993 | Hanatani et al. | 430/59 |
| 5,246,808 | 9/1993 | Hanatani et al. | 430/59 |
| 5,258,251 | 11/1993 | Hanatani et al. | 430/59 |
| 5,272,031 | 12/1993 | Hanatani et al. | 430/59 |

*Primary Examiner*—Roland Martin
*Attorney, Agent, or Firm*—Beveridge, DeGrandi, Weilacher & Young

[57] ABSTRACT

The present invention relates to a novel phenylenediamine derivative of the general formula (1):

(1)

wherein $R^1$ $R^2$ $R^3$ and $R^4$ are selected from the group consisting of: alkyl groups, alkoxy groups, halogen atoms and aryl groups; and m, n, p and q are integers in the range of 0 to 3, and an electrophotosensitive material using the same as an electric charge transferring material.

The phenylenediamine derivative is excellent in not only compatibility with binding resin but also electric charge transferring capability, particularly hole transferring capability. Therefore, a photosensitive material using the above derivative as an electric charge transferring material exhibits a higher sensitivity.

17 Claims, 3 Drawing Sheets

ELECTROPHOTOSENSITIVE MATERIAL USING A PHENYLENEDIAMINE DERIVATIVE

BACKGROUND OF THE INVENTION

The present invention relates to a novel phenylenediamine derivative which is suitably used as an electric charge transferring material, particularly hole transferring material in applications such as solar battery, electroluminescent device, electrophotosensitive material and the like, and an electrophotosensitive material using the same which is used for image forming apparatuses such as electrophotographic copying apparatus, laser beam printer and the like.

As the electric charge transferring material used for the above applications, there have been known carbazole compound, oxadiazole compound, pyrazoline compound, hydrazone compound, stilbene compound, phenylenediamine compound, benzidine compound and the like.

These electric charge transferring materials are normally used in a state at which they are dispersed in a membrane of a suitable binding resin.

In case of an electrophotosensitive material, there are widely used so-called organic photosensitive materials (OPC) such as:

a single layer type photosensitive material comprising a single layer photosensitive layer wherein the above electric charge transferring material and an electric charge generating material which generates an electric charge due to light irradiation are dispersed in a binding resin;

a multi-layer type photosensitive material comprising an electric charge transferring layer which contains an electric charge transferring material and an electric charge generating layer containing an electric charge generating material, and the like.

Such an organic photosensitive material has an advantage that it can be easily produced than an inorganic photosensitive material using an inorganic semi-conductor material, and has a wide selection of its material such as electric charge generating material, electric charge transferring material, binding resin, etc., thereby allowing a large latitude in functional design.

As the phenylenediamine compound being electric charge transferring material, an m-phenylenediamine derivative of the following formula (2) or a p-phenylenediamine derivative of the following formula (3) is generally used.

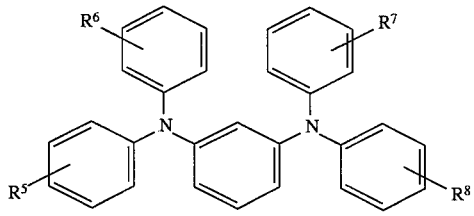

(2)

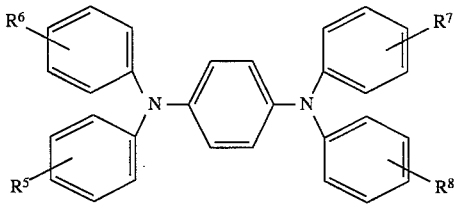

(3)

wherein $R^5$, $R^6$, $R^7$ and $R^8$ are the same or different and are selected from the group consisting of: hydrogen atoms, alkyl groups, alkoxy groups, halogen atoms and aryl groups which may have a substituent or not.

In the p-phenylenediamine derivative of the general formula (3), two nitrogen atoms, which form the central skeleton of molecule as well as the central benzene ring, are substituted by the benzene ring at the p-position. This causes a higher symmetric property of the molecular structure, thus being poor in compatibility with binding resin. In addition, its electric charge transferring capability is insufficient.

On the other hand, in the m-phenylenediamine derivative of the general formula (2), two nitrogen atoms which form the central skeleton of molecule as well as the central benzene ring, are substituted by the benzene ring at the m-position. Thus its symmetric property is lower than the p-phenylenediamine derivative.

However, as to the m-phenylenediamine derivative wherein each of the substituents $R^5$ to $R^8$ in the formula (2) is substituted with the 4-positions of phenyl groups, there has not succeeded yet in decreasing the symmetric property of the molecular structure to a desirable level, resulting in an insufficient compatibility with binding resin.

Accordingly, although the material itself is estimated to be excellent in electronic charge transferring capability, an electrophotosensitive material using this as an electric charge transferring material can not fully exhibit that excellent electric charge transferring capability, thus being insufficient in photosensitivity.

In contrast, the m-phenylenediamine derivative wherein the substituents $R^5$ to $R^8$ are substituted with the 3-positions of phenyl groups exhibits a lower symmetric property of the molecular structure, thus being excellent in compatibility with binding resin. However, its electric charge transferring capability is insufficient.

Therefore, an electrophotosensitive material using this as an electric charge transferring material fails to show a sufficient photosensitivity.

SUMMARY OF THE INVENTION

It is a main object of the present invention to provide a novel phenylenediamine derivative which is superior in not only electric charge transferring capability, particularly hole transferring capability, but also compatibility with binding resin.

It is another object of the present invention to provide an electrophotosensitive material having high sensitivity, which contains a phenylenediamine derivative as an electric charge transferring material.

In order to attain the above objects, the present inventors studied to improve not only compatibility with binding resin but also electric charge transferring capability by decreasing symmetric property of the molecular structure of phenylenediamine derivative, and they carried out molecular designing along this lines.

As a result, they had the following findings:

(a) Electric charge transferring capability is improved by changing from the m-position to the o-position at which two nitrogen atoms, which constitute the central skeleton of the phenylenediamine derivative, are substituted with the central benzene ring; and (b) In the o-substituted phenylenediamine derivative, there occurs a slight torsion in the molecular structure (whereas that is plane in the m-phenylenediamine) due to steric hindrance of phenyl groups substituted with both nitrogen atoms. This decreases symmetry, thereby improving compatibility with binding resin, to accomplish the present invention.

That is, the phenylenediamine derivative of the present invention is represented by the general formula (1):

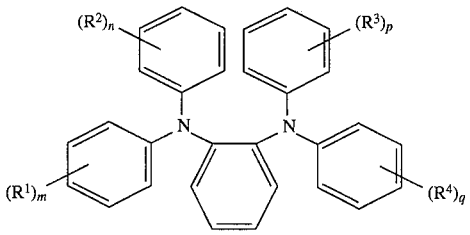

(1)

wherein $R^1$, $R^2$, $R^3$ and $R^4$ are the same or different and are selected from the group consisting of: alkyl groups, alkoxy groups, halogen atoms, and aryl groups which may have a substituent or not; and m, n, p and q are the same or different, and are integers in the range of 0 to 3.

The phenylenediamine derivative of the present invention is excellent in electric charge transferring capability as well as compatibility with binding resin. Therefore, this phenylenediamine derivative can be suitably used as an electric charge transferring material, particularly hole transferring material in applications such as solar battery, electroluminescent device, electrophotosensitive material and the like.

An electrophotosensitive material of the present invention comprises a photosensitive layer containing a phenylenediamine derivative represented by the general formula (1), provided on a conductive substrate.

This electrophotosensitive material comprises a photosensitive layer containing the phenylenediamine derivative as an electric charge transferring material. Therefore, it has sensitivity superior to that of conventional electrosensitive materials, and can contribute to realize speed-up and high performances of image forming apparatuses such as electrophotographic copying apparatus, laser beam printer and the like.

DETAILED DESCRIPTION OF THE INVENTION

Figure 1:
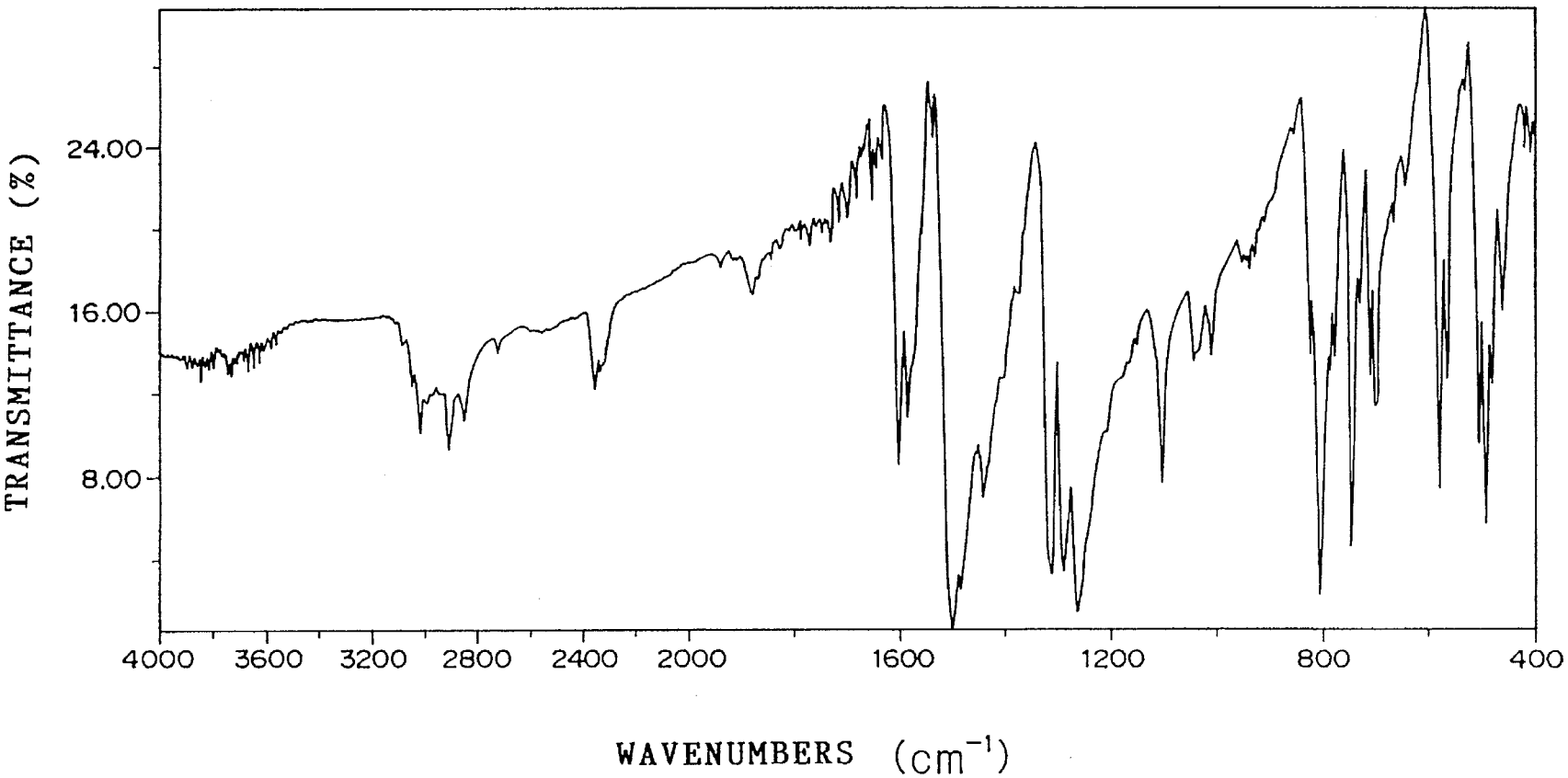
FIG. 1 is a graph illustrating the results of infrared spectroscopic analysis for the phenylenediamine derivative of Example 1 of the present invention.

The present invention will be described in detail as below.

The phenylenediamine derivative of the present invention is, as described above, represented by the general formula (1):

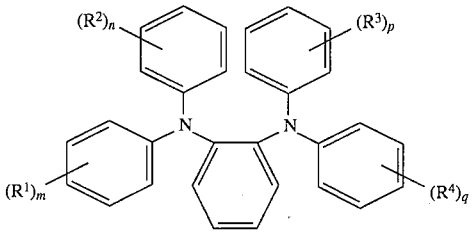

(1)

wherein $R^1$, $R^2$, $R^3$ and $R^4$ are the same or different and are selected from the group consisting of: alkyl groups, alkoxy groups, halogen atoms, and aryl groups which may have a lo substituent or not; and m, n, p and q are the same or different, and are integers in the range of 0 to 3.

Examples of the alkyl group corresponding to the groups $R^1$, $R^2$, $R^3$ and $R^4$ in the general formula (1) include lower alkyl groups having 1 to 6 carbon atoms such as methyl group, ethyl group, propyl group, isopropyl group, butyl group, isobutyl group, tert-butyl group, pentyl group, hexyl group, among others.

Examples of the alkoxy group include methoxy group, ethoxy group, isopropoxy group, butoxy group, tert-butoxy group, hexyloxy group and the like.

Examples of the halogen atom include fluorine atom, chlorine atom, bromine atom, iodine atom and the like.

Examples of the aryl group include phenyl group, biphenyl group, naphthyl group, anthryl group, phenanthryl group, o-terphenyl group, among others.

Examples of the substituent with which the aryl group may be substituted include the alkyl group, halogen atom or alkoxy group as mentioned above.

The number of being substituted with the respective groups defined by the symbol m, n, p or q in the general formula (1) can be optionally selected in the range of 0 to 3. The phenylenediamine derivative wherein m, n, p and q are 0 at the same time has a lower compatibility with binding resin, in spite of the lower symmetric property of the molecular structure as previously described. Therefore, it is desirable that m, n, p and q are not 0 at the same time. If consideration is given to the ease of production and the like, even within the range, smaller value of m, n, p or q is preferable, i.e. 2 is preferred to 3, but 1 is more preferred.

Examples of the phenylenediamine derivative include compounds wherein the substituents $R^1$ and $R^4$ are the same alkyl groups, $R^2$ and $R^3$ are the same alkyl groups which are the same as or different from that of $R^1$ and $R^4$, and m, n, p and q are 1 or 2.

Among those, the phenylenediamine derivative wherein m, n, p and q are 1 at the same time includes compounds wherein the substituents $R^1$ to $R^4$ is substituted with the 3position or the 4-position of phenyl groups. The phenylenediamine derivative wherein the substituent $R^1$ to $R^4$ is substituted with the 3-positions of phenyl groups is particularly excellent in compatibility with binding resin. The phenylenediamine derivative wherein the substituent $R^1$ to $R^4$ are substituted with the 4-positions of phenyl groups, is particularly excellent in electric charge transferring capability, and has compatibility with binding resin suitable for practical applications.

Non-limited examples of the phenylenediamine derivative wherein the substituent $R^1$ to $R^4$ are substituted with the 3-positions of phenyl groups include a compound represented by the formula (4):

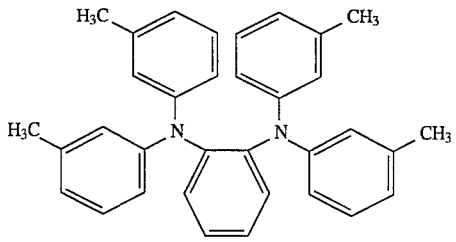

(4)

Non-limited examples of the phenylenediamine derivative wherein the substituents $R^1$ to $R^4$ are substituted with the 4-positions of phenyl groups include compounds represented by the formulas (5) and (6):

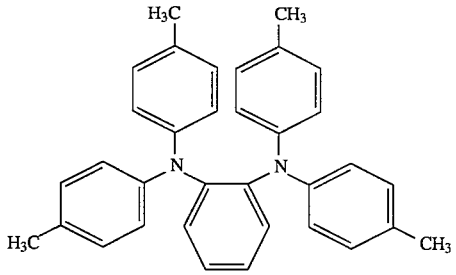

(5)

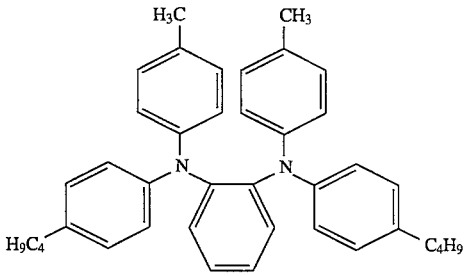

(6)

As a pheneylenediamine derivative wherein m, n, p and q are 2 at the same time, the preferred compound is that wherein one of two substituents with phenyl groups is substituted with the 4-position of the phenyl group, in view of electric charge transferring capability.

The electric charge transferring capability of this phenylenediamine derivative is far superior to that of a compound wherein the substituents $R^1$ to $R^4$ are substituted with the 4-position of phenyl groups, among the compounds wherein m, n, p and q are 1 at the same time in the foregoing.

Non-limited examples of this phenylenediamine derivative include compounds represented by the formulas (7) and (8):

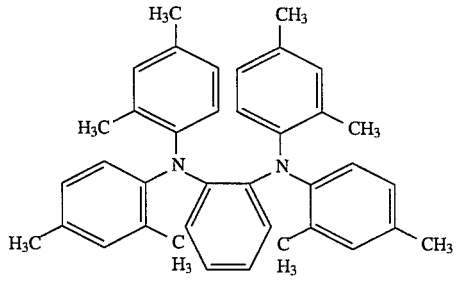

(7)

-continued

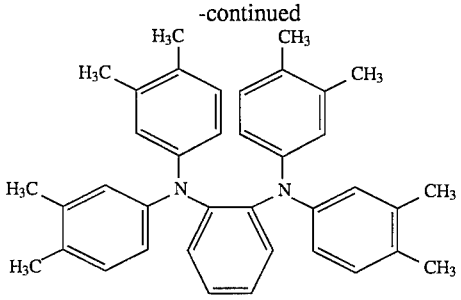

(8)

Other examples of the phenylenediamine derivative of the present invention include a compound wherein the substituents $R^1$ and $R^4$ are the same alkyl group, $R^2$ and $R^3$ are the same aryl group, and m, n, p and q are 1 at the same time; and a compound wherein $R^1$ and $R^4$ are the same aryl group, $R^2$ and $R^3$ are the same aryl group which is the same as or different from that of $R^1$ and $R^4$ and m n p and q are 1 at the same time.

These phenylenediamine derivatives are particularly excellent in electric charge transferring capability because a E-electron conjugate system is greatly enlarged by the aryl group.

It is desirable that the aryl group corresponding to the substituents $R^1$ to $R^4$ are substituted with the 4-positions of phenyl groups, in view of steric hindrance. When the substituents $R^1$ to $R^4$ are the same aryl groups, it is preferred that each aryl group is substituted with the substituent in order to hold compatibility with binding resin. Although the position at which the substituent is substituted is not specifically limited, when the aryl group is a phenyl group, a compound wherein the substituents are substituted with the 4-positions of phenyl groups, exhibits a higher electric charge transferring capability.

Non-limited examples of the phenylenediamine derivative wherein $R^1$ and $R^4$ are alkyl groups, $R^2$ and $R^3$ are aryl groups, and m, n, p and q are 1 at the same time include compounds represented by the formulas (9) and (10):

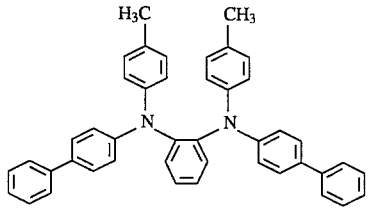

(9)

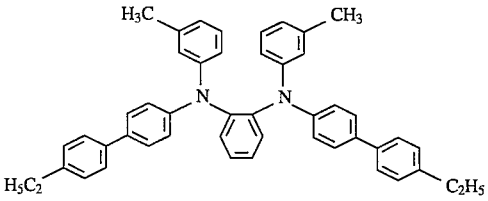

(10)

Non-limited examples of the phenylenediamine derivative wherein $R^1$ to $R^4$ are aryl groups, and m, n, p and q are 1 at the same time include a compound represented by the formula (11):

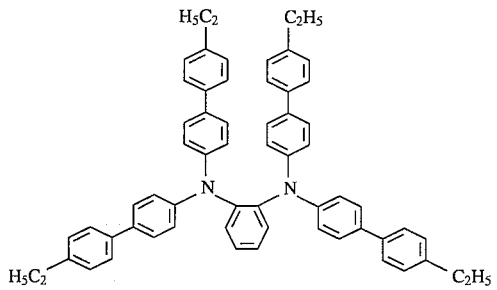

(11)

The phenylenediamine derivative of the present invention can be synthesized by various methods. For example, the phenylenediamine derivative of the formula (5) can be synthesized according to the following reaction scheme.

That is, o-phenylenediamine of the formula (12) is mixed with p-iodotoluene of the formula (13) in a molar ratio of 1:4 together with copper powder, copper oxide or halogenated copper, and the mixture is reacted under the presence of a basic substance to synthesize a phenylenediamine derivative of the formula (5).

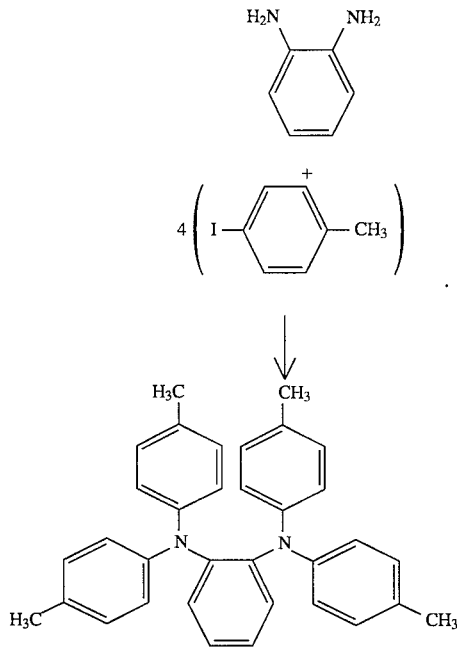

(12)

(13)

(5)

This phenylenediamine derivative is suitably used as an electric charge transferring material, particularly hole transferring material, in applications such as solar battery, electroluminescent device, electrophotosensitive material and the like, and applicable to other various fields, as previously described.

The electrophotosensitive material of the present invention comprises a photosensitive layer containing at least one sort of the phenylenediamine derivative represented by the formula (1), provided on a conductive substrate. There are two types of photosensitive layers; "single layer photosensitive layer" and "multi-layer photosensitive layer", both of which are applicable to the present invention.

The single layer photosensitive layer can be formed by applying a coating solution, which is prepared by dissolving or dispersing a phenylenediamine derivative represented by the general formula (1) as an electric charge transferring material, an electric charge generating material and a binding resin in a suitable solvent, on a conductive substrate by means of an application or the like, followed by drying.

The multi-layer photosensitive layer can be formed by forming an electric charge generating layer containing an electric charge generating material on a conductive substrate by means of a deposition, an application or the like, applying a coating solution, which contains a binding resin and a pheneylenediamine derivative represented by the general formula (1) as an electric charge transferring material, on the electric charge generating layer by means of an application or the like, followed by drying to form an electric charge transferring layer. In reverse, the electric charge generating layer may be formed on the electric charge transferring layer on a conductive substrate.

Non-limited examples of electric charge generating material include powder of inorganic conductive materials (e.g. selenium, selenium-tellurium, selenium-arsenic, cadmium sulfide, s-silicon, etc), azo pigments, perylene pigments, anthanthrone pigments, phthalocyanine pigments, indigo pigments, triphenylmethane pigments, therene pigments, toluidine pigments, pyrazoline pigments, quinacridon pigments, dithioketopyrrolopyrrole pigments and the like. These electric charge generating materials can be used alone or in combination thereof depending upon sensitivity in the wavelength region of electrophotosensitive material.

Examples of electric charge generating material suitable for an organic photosensitive material, which has sensitivity in the wavelength region of not less than 700 nm, include phthalocyanine pigments such as X-type metal-free phthalocyanine and oxotitanyl phthalocyanine, among others.

An electrophotosensitive material, which employs these phthalocyanine pigments as an electric charge generating material and the phenylenediamine derivative represented by the general formula (1) as an electric charge transferring material, exhibits a higher sensitivity in the wavelength region above-mentioned. Accordingly, it can suitably used for digital optical system image forming apparatuses such as laser beam printer, facsimile and the like.

On the other hand, examples of electric charge generating material suitable for an organic photosensitive material, which as a higher sensitivity in the visible region, include azo pigments, perylene pigments, among others.

An electrophotosensitive material, which employs these pigments as an electric charge generating material and the phenylenediamine derivative represented by the general formula (1) as an electric charge transferring material, exhibits a higher sensitivity in the visible region. Therefore, it can be suitably used for analogue optical system image forming apparatuses such as electrophotographic copying apparatus and the like.

The phenylenediamine derivative represented by the general formula (1), as an electric charge transferring material, can be used alone or in combination with other electric charge transferring material being conventionally known.

Examples of other electric charge transferring material include various electron transferring materials and hole transferring materials.

Examples of electron transferring material include electron attractive materials such as diphenoxy compounds, benzoquinone compounds, naphthoquinone compounds, malononitrile, thiopyran compounds, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomthylenefluorenone, 2,4,5,7tetranitroxanthone, 2,4,8-trinitrothioxanthone, dinitrobenzene, dinitroanthracene, dinitroacridine, nitroanthraquinone, dinitroanthraquinone, succinic anhydride, maleic anhydride, dibromomaleic anhydride, etc., those wherein the above mentioned electron attractive materials have been polymerized, among others.

Examples of hole transferring material include electron donative materials such as nitrogen-containing cyclic compounds and condensed polycyclic compounds which include diamine compounds other than the phenylenediamine derivative represented by the general formula (1); diazole compounds such as 2,5-di(4-methylaminophenyl)-l,3,4-oxadiazole, etc.; styryl compounds such as 9-(4-diethylaminostyryl)anthracene, etc.; carbazole compounds such as polyvinyl carbazole, etc.; pyrazoline compounds such as 1-phenyl-3-(p-dimethylaminophenl)pyrazoline, etc.; hydrazone compounds; triphenylamine compounds; indol compounds; oxazole compounds; isooxazole compounds, thiazole compounds; thiadiazole compounds; imidazole compounds; pyrazole compounds; triazole compounds, among others.

These electric charge transferring materials can be used alone or in combination thereof. When using such an electric charge transferring material having film forming properties as polyvinyl carbazole, a binding resin is not necessarily required.

Examples of binding resin include thermoplastic resins such as styrene polymer, styrene-butadiene copolymer, styrene-acrilonitrile copolymer, styrene-maleic acid copolymer, acrylic polymer, styrene-acrylic copolymer, polyethylene, ethylene-vinyl acetate copolymer, chlorinated polyethylene, polyvinyl chloride, polypropylene, vinyl chloride-vinyl acetate copolymer, polyester, alkyd resin, polyamide, polyurethane, polycarbonate, polyacrylate, polysulfon, diaryl phthalate resin, ketone resin, polyvinyl butyral resin, polyether resin, etc.; crosslinking thermosetting resins such as silicone resin, epoxy resin, phenol resin, urea resin, melamine resin, etc.; photosetting resins such as epoxy acrylate, urethane acrylate, etc. These binding resins can be used alone or in combination thereof.

To a photosensitive layer, there can be added additives such as sensitizers, fluorene compounds, ultraviolet absorbers, plasticizers, surfactants, leveling agents, etc. in addition to the components in the foregoing. Further, in order to improve sensitivity of a photosensitive material, sensitizers such as terphenyl, halonaphthoquinones, acenaphthylene, etc. may be jointly used with an electric charge generating agent.

In a multi-layer type photosensitive material, an electric charge generating material and a binding resin, which constitute an electric charge generating layer, may be used in various proportions. It is desirable to use 5 to 1000 parts by weight, particularly 30 to 500 parts by weight of the electric charge generating material for 100 parts by weight of the binding resin.

An electric charge transferring material and a binding resin, which constitute an electric charge transferring layer, can be used in various proportions within the range in which there occurs neither inhibition of electric charge transmission nor crystallization of the electric charge transferring material.

In order that electric charge generated in the electric charge generating layer due to light irradiation can be easily transferred, it is desirable to use 10 to 500 parts by weight, particularly 25 to 200 parts by weight of electric charge transferring material containing a phenylenediamine derivative of the general formula (1), for 100 parts by weight of binding resin. When using this phenylenediamine derivative alone, the amount of the electric charge transferring material is that of the phenylenediamine derivative.

As to thickness of a multi-layer photosensitive layer, it is desirable to have the following thickness: about 0.01 to 5 μm for an electric charge generating layer, particularly about 0.1 to 3 μm; about 2 to 100 μm, particularly about 5 to 50 μm for an electric charge transferring layer.

In a single layer type photosensitive material, a suitable amount of electric charge generating material is in the range of 0.1 to 50 parts by weight, particularly 0.5 to 30 parts by weight, and a suitable total amount of electric charge transferring material containing a phenylenediamine derivative of the general formula (1) is in the range of 20 to 500 parts by weight, particularly 30 to 200 parts by weight, for 100 parts by weight of binding resin.

When using this phenylenediamine derivative alone, the amount of the electric charge transferring material is that of the phenylenediamine derivative.

It is desirable that the film thickness of the single layer photosensitive layer is 5 to 100 μm, particularly 10 to 50 μm.

A barrier layer may be formed in such a range as not to inhibit the characteristics of photosensitive material, for a single layer type photosensitive material, between a conductive substrate and a photosensitive layer or between the conductive substrate and an electric charge generating layer; for the multi-layer type photosensitive material, between an conductive substrate and an electric charge transferring layer or between an electric charge generating layer and the electric charge transferring layer.

Further, a protective layer may be formed on the surface of photosensitive material.

As a conductive substrate on which the above respective layers are formed, there can be used various materials having conductivity. Examples thereof include metals such as aluminum, copper, tin, platinum, silver, vanadium, molybdenum, chromium, cadmium, titanium, nickel, palladium, indium, stainless steel, brass, etc.; plastic materials vapor-deposited or laminated with the above metal; glass materials coated with aluminum iodide, tin oxide, indium oxide, among others.

The conductive substrate may be in the form of a sheet or a drum depending upon the structure of an image forming apparatus to be used. Either the substrate itself or the surface thereof may have conductivity. It is desirable that the conductive substrate has a sufficient mechanical strength at the time of use.

In case of forming the respective layer constituting photosensitive material by a coating method, an electric charge generating material, an electric charge transferring material, a binding resin, etc. may be dispersed/mixed with a suitable solvent by known means such as a roll mill, a ball mill, an atriter, a paint shaker, a supersonic dispenser to prepare a coating solution, which is applied by known means and then allowed to dry.

As a solvent for preparing a coating solution, there can be used various organic solvents. Examples thereof include alcohols such as methanol, ethanol, isopropanol, butanol, etc.; aliphatic hydrocarbons such as n-hexane, octane, cyclohexane, etc.; aromatic hydrocarbons such as benzene, toluene, xylene, etc.; halogenated hydrocarbons such as dichloromethane, dichloroethane, carbon tetrachloride, chlorobenzene, etc.; ethers such as dimethyl ether, diethyl ether, tetrahydrofuran, ethylene glycol dimethyl ether, diethylene glycol dimethyl ether, etc.; ketones such as acetone, methyl ethyl ketone, cyclohexanone, etc.; esters such as ethyl acetate, methyl acetate, etc.; dimethylformaldehyde, dimethylformamide, dimethylsulfoxide, etc. These solvents may be used alone or in combination thereof.

Moreover, in order to improve dispersibility of an electric charge transferring material and an electric charge generating material as well as smoothness of the surface of a photosensitive layer, there may be added surfactants, leveling agents, etc. to a coating solution.

EXAMPLES

Following Examples and Comparative Examples will describe the present invention in detail.

Synthesis of phenylenediamine derivative

Example 1

N,N,N',N'-tetrakis(4-methylphenyl)-o-phenylenediamine 5.4 G of o-phenylenediamine of the formula (12), 42.6 g of p-iodotoluene of the formula (13), 27.6 g of potassium carbonate and 2 g of copper powder were added in 300 ml of nitrobenzene, and the mixture was refluxed while a nitrogen gas was blowing into this reaction system under vigorous stirring for 24 hours. The water generated by the reaction was removed out of the reaction system by azeotropic distillation with nitrobenzene.

After the reaction solution was cooled, an inorganic substance was filtered off. Further, nitrobenzen was distilled off by steam distillation to give the residue, which was dissolved in cyclohexane. The solution was purified by subjecting to silica gel column chromatography and cyclohexane was distilled off to give a white precipitation. Then, the white precipitation was recrystallized from n-hexane to obtain the expected compound of the formula (5) (12.2 g, yield: 52.1%).

FIG. 1 shows the results of the infrared spectroscopic analysis for the resulting compound.

The results of other analyses are shown below.

Elemental analysis (%)

Calcd.: C, 87.15; H, 6.88; N, 5.98

Found: C, 87.21; H, 7.00; N, 5.80

Melting point: 186.4° C. (DSC)

Example 2

N,N,N',N'-tetrakis(3-methylphenyl)-o-phenylenediamine

The procedure of Example 1 was repeated except the use of 5.4 g of o-phenylenediamine of the formula (12) and 42.6 g of m-iodotoluene of the formula (14):

(14)

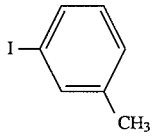

as a starting material to obtain the expected compound of the formula (4) (12.6 g, yield: 55.1%).

Figure 2:
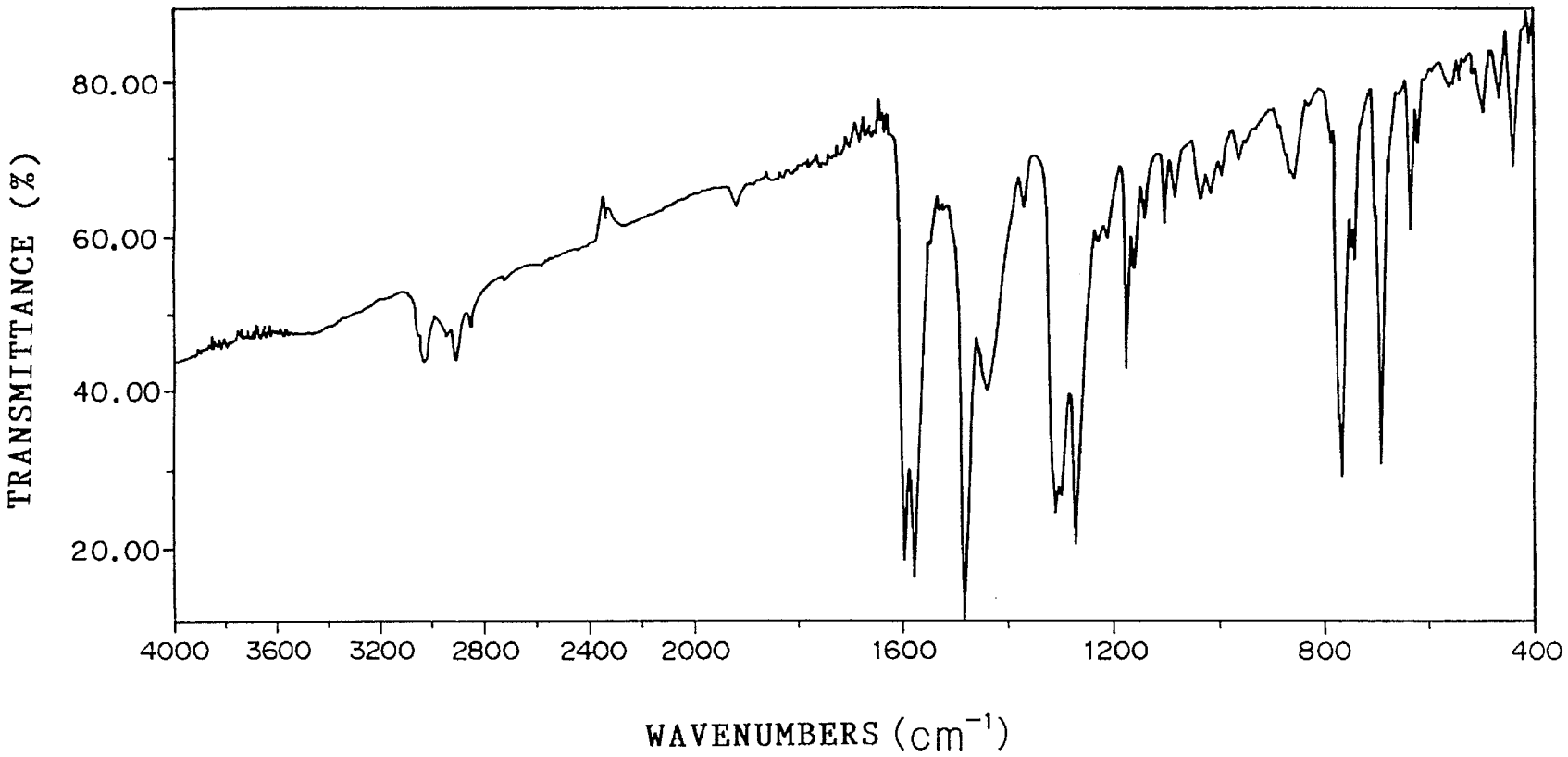
FIG. 2 is a graph illustrating the results of infrared spectroscopic analysis for the phenylenediamine derivative of Example 2 of the present invention.

FIG. 2 shows the results of the infrared spectroscopic analysis for the resulting compound.

The results of other analyses are shown below.

Elemental analysis (%)

Calcd.: C, 87.15; H, 6.88; N, 5.98

Found: C, 87.11; H, 6.91; N, 5.98

Melting point: 138.1° C. (DSC)

Example 3

N,N,N'',N'-tetrakis(4'-ethylbiphenyl-4-yl)-o-phenylenediamine

The procedure of Example 1 was repeated except the use of 5.4 g of o-phenylenediamine of the formula (12) and 60.2 g of 4-ethyl-4'-iodobiphenyl of the formula (15):

(15)

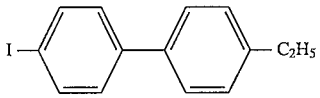

as a starting material to obtain the expected compound of the formula (11) (20.4 g, yield: 50.3 %).

Figure 3:
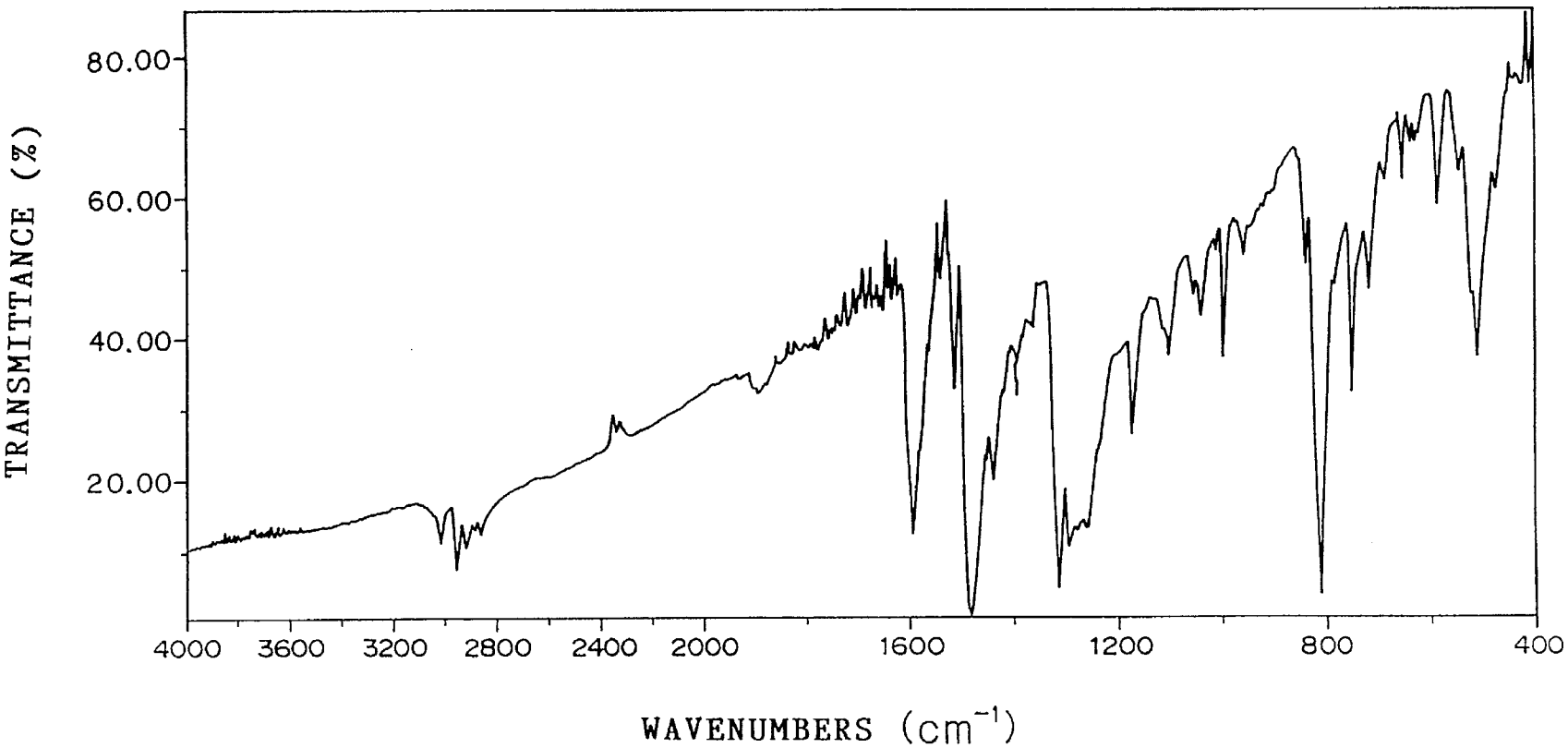
FIG. 3 is a graph illustrating the results of infrared spectroscopic analysis of the phenylenediamine derivative of Example 3 of the present invention.

FIG. 3 shows the results of the infrared spectroscopic analysis for the resulting compound.

The results of other analyses are shown below.

Elemental analysis (%)

Calcd.: C, 89.80; H, 6.82; N, 3.38

Found: C, 89.82; H, 6.81; N, 3.36

Melting point: 254.1° C. (DSC)

Examples 4–11 and Comparative Examples 1–2

(Single layer type photosensitive material for digital light source)

5 Parts by weight of X-type metal-free phthalocyanine as an electric charge generating material, 50 parts by weight of a phenylenediamine derivative as a hole transferring material, 30 parts by weight of 3,5-dimethyl-3',5'-di-tert-butyldiphenoquinone of the formula (16):

(16)

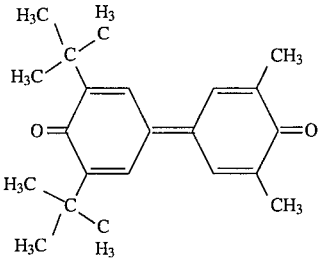

as an electron transferring material and 100 parts by weight of polycarbonate as a binding resin were mixed/dispersed with 800 parts by weight of tetrahydrofuran as a solvent by using a ball mill for 50 hours to prepare a coating solution for a single layer photosensitive layer.

Then, this coating solution was applied on an aluminum tube as a conductive substrate by a dip coating method, followed by hot-air drying at 100° C. for 60 minutes. There was obtained a single layer type photosensitive material for digital light source, which had a single layer photosensitive layer of 15 to 20 μm in film thickness.

Table 1 embodies the phenylenediamine derivatives used in these Examples and Comparative Examples by compound number.

The phenylenediamine derivatives used in Comparative Examples 1 and 2 are described by the formulas (17) and (18);

(17)

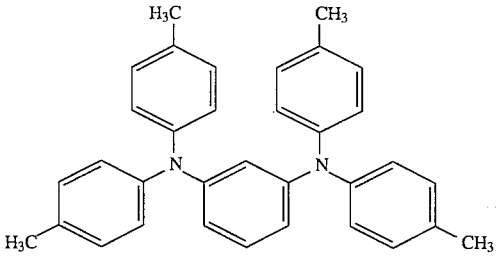

-continued

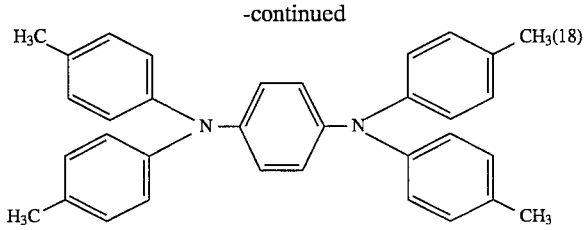

The following test (I) of initial electric characteristics was conducted for each photosensitive material to evaluate the characteristics.

Test (I) of initial electric characteristics

Using a drum sensitivity tester manufactured by GEN-TEC Co., a voltage was applied on the surface of the photosensitive materials of Examples and Comparative Examples to charge the surface at +700 V.

Monochromatic light having a wavelength of 780 nm (half-width: 20 nm) and a light intensity of 16 $\mu W/cm^2$, which was made by passing white light of a halogen lamp being exposure light source through a band-pass filter, was irradiated on the surface of each photosensitive material for msec. (irradiation time).

Then, there was measured the time required for a surface potential to be reduced to be one-half, i.e. +350 V, thereby calculating a half-life light exposure $E_{1/2}$ ($\mu J/cm^2$). Further, a surface potential after an elapse of 330 msec. since the beginning of exposure was determined as a potential after exposure $V_L$ (V).

The results are summarized in Table 1.

TABLE 1

| | Phenylenediamine derivative | $V_L$ (V) | $E_{1/2}$ ($\mu J/cm^2$) |
|---|---|---|---|
| Example 4 | (4) | 194 | 1.13 |
| Example 5 | (5) | 185 | 1.06 |
| Example 6 | (6) | 187 | 1.05 |
| Example 7 | (7) | 186 | 1.00 |
| Example 8 | (8) | 181 | 0.98 |
| Example 9 | (9) | 178 | 0.97 |
| Example 10 | (10) | 180 | 0.99 |
| Example 11 | (11) | 178 | 0.96 |
| Com. Example 1 | (17) | 202 | 1.25 |
| Com. Example 2 | (18) | 208 | 1.27 |

Followings are noted by inspection of Table 1.

Comparative Example 1 using the phenylenediamine derivative (17) which belongs to the m-phenylenediamine derivative of the formula (2), and Comparative Example 2 using the phenylenediamine derivative (18) which belongs to the p-phenylenediamine derivative of the formula (3) have a larger half-life light exposure $E_{1/2}$ ($\mu J/cm^2$) and a higher potential after exposure $V_L$ (V), thus being poor in sensitivity.

Examples 4 through 11 using the phenylenediamine derivatives (4) to (11) which belong to the phenylenediamine derivative of the formula (1) have a smaller half-life light exposure $E_{1/2}$ ($\mu J/cm^2$) and a lower potential after exposure $V_L$ (V), thus being excellent in sensitivity.

Comparison are made for Examples 4, 5 and 6 using the phenylenediamine derivatives (4), (5) and (6) which belong to the phenylenediamine derivative of the general formula (1) wherein the substituents $R^1$ to $R^4$ are alkyl groups, and m, n, p and q are 1 at the same time.

Examples 5 and 6 using the phenylenediamine derivatives (5) and (6) wherein the alkyl groups are substituted with the 4-positions of phenyl groups, have sensitivity superior to that of Example 4 using the phenylenediamine derivative (4) wherein the alkyl groups are substituted with the 3-positions of the phenyl groups.

Further, Examples 5 and 6 are compared with Examples 7 and 8 using the phenylenediamine derivatives (7) and (8) which correspond to the phenylenediamine derivative of the formula (1), wherein the substituents $R^1$ to $R^4$ are alkyl groups, and m, n, p and q are 2 at the same time, and one of the two alkyl groups substituted with phenyl groups are substituted with the 4-position of the phenyl group.

The latter (Examples 7 and 8) has sensitivity superior to that of the former (Examples 5 and 6).

Furthermore, Examples 5 through 8 are compared with Examples 9 and 10 using the phenylenediamine derivatives (9) and (10) which correspond to the phenylenediamine derivative of the formula (1) wherein the substituents $R^1$ and $R^4$ are alkyl groups substituted with the 4-positions of phenyl groups, $R^2$ and $R^3$ are aryl groups substituted with the 4-positions of phenyl groups, and m, n, p and q are 1; and with Example 11 using the phenylenediamine derivative (11) which corresponds to the phenylenediamine derivative of the formula (1) wherein the substituents $R^1$ to $R^4$ are aryl groups substituted with the 4-positions of phenyl groups, and m, n, p and q are 1 at the same time.

The latter (Examples 9 through 11) has sensitivity superior to that of the former (Examples 5 through 8).

Examples 12–13

(Multi-layer type photosensitive material for digital light source)

2 Parts by weight of X-type metal-free phthalocyanine as an electric charge generating material and 1 part by weight of polyvinyl butyral as a binding resin were mixed/dispersed with 120 parts by weight of dichloromethane as a solvent by using a ball mill to prepare a coating solution for an electric charge generating layer.

Then, this coating solution was applied on an aluminum tube as a conductive substrate by a dip coating method, followed by hot-air drying at 100° C. for 60 minutes to form an electric charge generating layer of 0.5 μm in film thickness.

Separately, 80 parts by weight of a phenylenediamine derivative as an electric charge transferring material and 100 parts by weight of polycarbonate as a binding resin were mixed/dispersed with 800 parts by weight of benzene as a solvent by using a ball mill to prepare a coating solution for an electric charge transferring layer.

Then, this coating solution was applied on the electric charge generating layer by a dip coating method, followed by hot-air drying at 90° C. for 60 minutes to form an electric charge transferring layer of 15 μm in film thickness. There was obtained a multi-layer type photosensitive material for digital light source.

Table 2 embodies the phenylenediamine derivative used in these Examples by compound number.

The following test (II) of initial electric characteristics was conducted for the photosensitive materials of both Examples, and their characteristics were evaluated.

Test (II) of initial electric characteristics

Using a drum sensitivity tester manufactured by GEN-TEC Co., a voltage was applied on the surface of the photosensitive materials of both Examples to charge the surface at −700 V.

Monochromatic light having a wavelength of 780 nm (half-width: 20 nm) and a light intensity of 16 μW/cm$^2$, which was made by passing white light of a halogen lamp being exposure light source through a band-pass filter, was irradiated on the surface of each photosensitive material for 80 msec.(irradiation time).

Then, there was measured the time required for a surface potential to be reduced to be one-half, i.e. −350 V, thereby calculating a half-life light exposure $E_{1/2}$ (μJ/cm$^2$). Further, a surface potential after an elapse of 330 msec. since the beginning of exposure was determined as a potential after exposure $V_L$ (V)

The results are summarized in Table 2.

TABLE 2

| | Phenylenediamine derivative | $V_L$ (V) | $E_{1/2}$ (μJ/cm$^2$) |
|---|---|---|---|
| Example 12 | (5) | −142 | 0.64 |
| Example 13 | (11) | −138 | 0.61 |

Followings are noted by inspection of Table 2.

Example 12 and 13 using the phenylenediamine derivatives (5) and (11) which belong to the phenylenediamine derivative of the general formula (1) have a smaller half-life light exposure $E_{1/2}$ (μJ/cm$^2$) and a lower potential after exposure $V_L$ (V), thus being excellent in sensitivity.

Example 13 using the phenylenediamine derivative (11) wherein the substituents $R^1$ to $R^4$ are aryl groups substituted with the 4-positions of phenyl groups, has sensitivity superior to that of Example 12 using the phenylenediamine derivative (5) wherein corresponding $R^1$ to $R^4$ are alkyl groups.

Examples 14–21 and Comparative Examples 3–4

(Single layer type photosensitive material for analogue light source) 5 Parts by weight of azo pigment of the formula (19):

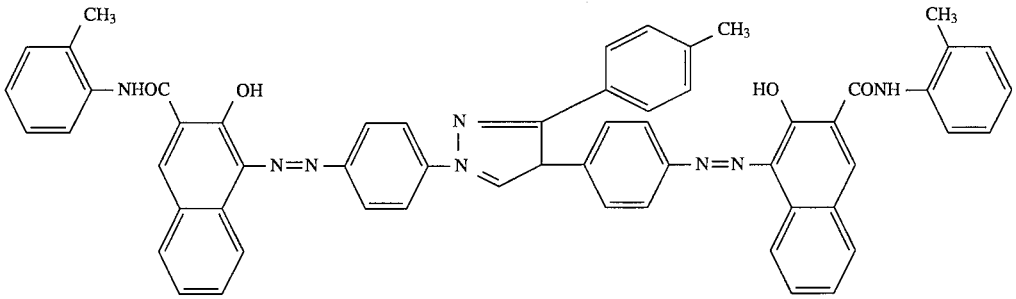

(19)

as an electric charge generating material, 70 parts by weight of phenylenediamine derivative as a hole transferring material, 20 parts by weight of 3,5-dimethyl-3',5'-di-tertbutyl-diphenoquinone of the formula (16) as an electron transferring material and 100 parts by weight of polycarbonate as a binding resin were mixed/dispersed with 800 parts by weight of tetrahydrofuran as a solvent by using a ball mill for 50 hours to prepare a coating solution for a single layer photosensitive layer.

Then, this coating solution was applied on an aluminum tube as a conductive substrate by a dip coating method, followed by hot-air drying at 100° C. for 60 minutes. There was obtained a single layer type photosensitive material for analogue light source, which had a single layer photosensitive layer of 15 to 20 μm in film thickness.

Table 3 embodies the phenylenediamine derivative used in these Examples and Comparative Examples by compound number.

The following test (III) of initial electric characteristics was conducted for each photosensitive materials to evaluate the characteristics.

Test (III) of initial electric characteristics

Using a drum sensitivity tester manufactured by GEN-TEC Co., a voltage was applied on the surface of the photosensitive materials of each Example and Comparative Example to charge the surface at +700 V.

White light (light intensity: 147 μW/cm$^2$) of a halogen lamp being exposure light source was irradiated on the surface of each photosensitive material for 50 msec. (irradiation time).

Then, there was measured the time required for a surface potential to be reduced to be one-half, i.e. +350 V, thereby calculating a half-life light exposure $E_{1/2}$ (μJ/cm$^2$). Further, a surface potential after an elapse of 330 msec. since the beginning of exposure was determined as a potential after exposure $V_L$ (V).

The results are summarized in Table 3.

TABLE 3

| | Phenylenediamine derivative | $V_L$ (V) | $E_{1/2}$ (μJ/cm$^2$) |
|---|---|---|---|
| Example 14 | (4) | 208 | 4.26 |
| Example 15 | (5) | 202 | 4.12 |
| Example 16 | (6) | 199 | 4.09 |
| Example 17 | (7) | 192 | 3.98 |
| Example 18 | (8) | 197 | 4.01 |
| Example 19 | (9) | 189 | 3.90 |
| Example 20 | (10) | 190 | 3.92 |
| Example 21 | (11) | 187 | 3.90 |
| Com. Example 3 | (17) | 217 | 4.42 |

TABLE 3-continued

| | Phenylenediamine derivative | $V_L$ (V) | $E_{1/2}$ (μJ/cm$^2$) |
|---|---|---|---|
| Com. Example 4 | (18) | 220 | 4.54 |

Followings are noted by inspection of Table 3.

Comparative Example 3 using the phenylenediamine derivative (17) which belongs to the m-phenylenediamine derivative of the formula (2), and Comparative Example 4 using the phenylenediamine derivative (18) which belongs to the p-phenylenediamine derivative of the formula (3) have a larger half-life light exposure $E_{1/2}$ (μJ/cm$^2$) and a higher potential after exposure $V_L$ (V), thus being poor in sensitivity.

Examples 14 through 21 using the phenylenediamine derivatives (4) to (11) which belong to the phenylenediamine derivative of the formula (1) have a smaller half-life light exposure $E_{1/2}$ (μJ/cm$^2$) and a lower potential after exposure $V_L$ (V), thus being excellent in sensitivity.

Comparison is made for Examples 14, 15 and 16 using the phenylenediamine derivatives (4), (5) and (6), which belong to the phenylenediamine derivative of the general formula (1) wherein the substituents $R^1$ to $R^4$ are alkyl groups, and m, n, p and q are 1 at the same time.

Examples 15 and 16 using the phenylenediamine derivatives (5) and (6) wherein the alkyl groups are substituted with the 4-positions of phenyl groups, have sensitivity superior to that of Example 14 using the phenylenediamine derivative (4) wherein the alkyl groups are substituted with the 3-positions of phenyl groups.

Further, Examples 15 and 16 are compared with Examples 17 and 18 using the phenylenediamine derivatives (7) and (8) which correspond to the phenylenediamine derivative of the formula (1) wherein the substituents $R^1$ to $R^4$ are alkyl groups, m, n, p and q are 2 at the same time, and one of the alkyl groups substituted with phenyl groups is substituted with the 4-position of the phenyl group.

The later (Examples 17 and 18) has sensitivity superior to that of the former (Examples 15 and 16).

Furthermore, Examples 15 through 18 are compared with Examples 19 and 20 using the phenylenediamine derivatives (9) and (10), which correspond to the phenylenediamine derivative of the formula (1) wherein the substituents $R^1$ and $R^4$ are alkyl groups substituted with the 4-positions of phenyl groups, $R^2$ and $R^3$ are aryl groups substituted with the 4-positions of phenyl groups, and m, n, p and q are 1 at the same time; and with Example 21 using the phenylenediamine derivative (11), which corresponds to the phenylenediamine derivative of the formula (1) wherein the substituents $R^1$ to $R^4$ are aryl groups substituted with the 4-positions of phenyl groups, and m, n, p and q are 1 at the same time.

The latter (Examples 19 to 21) has sensitivity superior to that of the former (Examples 15 to 18).

Examples 22–29 and Comparative Examples 5–6

(Single layer type photosensitive material for analogue light source)

The procedure of Examples 14–21 and Comparative Examples 3–4 was repeated except the use of 5 parts by weight of azo pigment of the formula (20):

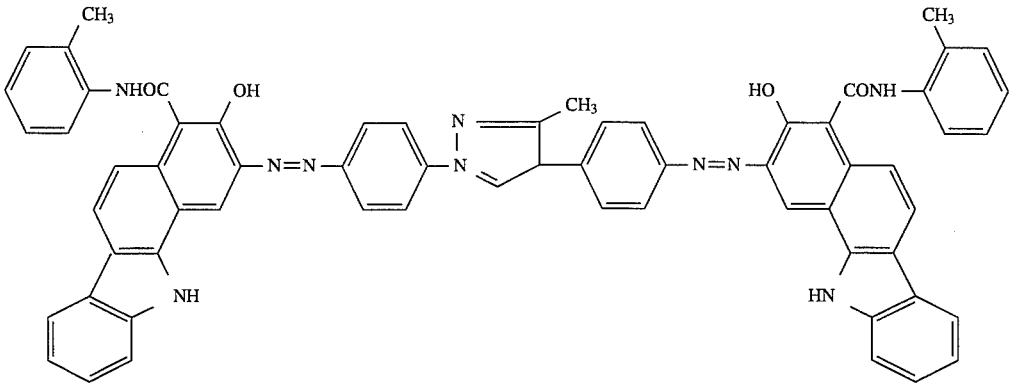

(20)

as an electric charge generating material to obtain a single layer type photosensitive material for analogue light source, which had a single layer photosensitive layer of 15 to 20 μm in film thickness.

Table 4 embodies the phenylenediamine derivative used in these Examples and Comparative Examples by compound number.

The above test (III) of initial electric characteristics was conducted for each photosensitive material to evaluate the characteristics.

The results are summarized in Table 4.

TABLE 4

| | Phenylenediamine derivative | $V_L$ (V) | $E_{1/2}$ (μJ/cm$^2$) |
|---|---|---|---|
| Example 22 | (4) | 205 | 4.14 |
| Example 23 | (5) | 198 | 4.09 |
| Example 24 | (6) | 200 | 4.10 |
| Example 25 | (7) | 195 | 4.07 |
| Example 26 | (8) | 198 | 4.08 |
| Example 27 | (9) | 192 | 3.94 |
| Example 28 | (10) | 189 | 3.92 |
| Example 29 | (11) | 191 | 3.91 |
| Com. Example 5 | (17) | 227 | 4.56 |
| Com. Example 6 | (18) | 224 | 4.55 |

Followings are noted by inspection of Table 4.

Comparative Example 5 using the phenylenediamine derivative (17) which belongs to the m-phenylenediamine derivative of the formula (2) and Comparative Example 6 using the phenylenediamine derivative (18) which belongs to the p-phenylenediamine derivative of the formula (3) have a larger half-life light exposure $E_{1/2}$ (μJ/cm$^2$) and a higher potential after exposure $V_L$ (V), thus being poor in sensitivity.

Examples 22 through 29 using the phenylenediamine derivatives (4) to (11) which belong to the phenylenediamine derivative of the formula (1) have a smaller half-life light exposure $E_{1/2}$ (μJ/cm$^2$) and a lower potential after exposure $V_L$ (V), thus being excellent in sensitivity.

Comparison is made for Examples 22, 23 and 24 using the phenylenediamine derivatives (4), (5) and (6) which belong to the phenylenediamine derivative of the formula (1) wherein the substituents $R^1$ to $R^4$ are alkyl groups, and m, n, p and q are 1 at the same time.

Examples 23 and 24 using the phenylenediamine derivatives (5) and (6) wherein the alkyl groups are substituted with the 4-positions of phenyl groups, have sensitivity superior to that of Example 22 using the phenylenediamine derivative (4) wherein the alkyl groups are substituted with the 3-positions of phenyl groups.

Further, Examples 23 and 24 are compared with Examples 25 and 26 using the phenylenediamine derivatives (7) and (8), which correspond to the phenylenediamine derivative of the formula (1) wherein the substituents $R^1$ to $R^4$ are alkyl groups, m, n, p and q are 2 at the same time, and one of the two alkyl groups substituted with phenyl groups is substituted with the 4-position of the phenyl group.

Example 25 using the phenylenediamine derivative (7) has sensitivity superior to that of Examples 23 and 24.

Example 26 using the phenylenediamine derivative (8) has sensitivity equivalent to that of Example 23, and has sensitivity superior to that of Example 24.

Further, Examples 23 through 26 are compared with Examples 27 and 28 using the phenylenediamine derivatives (9) and (10) which correspond to the phenylenediamine derivative of the formula (1), wherein the substituents $R^1$ and $R^4$ are alkyl groups substituted with the 4-positions of phenyl groups, $R^2$ and $R^3$ are aryl groups substituted with the 4positions of phenyl groups, and m, n, p and q are 1 at the same time; and with Example 29 using the phenylenediamine derivative (11) which corresponds to the phenylenediamine derivative of the formula (1), wherein the substituents $R^1$ to $R^4$ are aryl groups substituted with the 4-positions of phenyl groups, and m, n, p and q are 1 at the same time.

The latter (Examples 27 through 29) has sensitivity superior to that of the former (Examples 23 through 26).

Examples 30–37 and Comparative Examples 7–8

(Single layer type photosensitive material for analogue light source)

The procedure of Examples 14–21 and Comparative Examples 3–4 was repeated except the use of 5 parts by weight of azo pigment of the formula (21):

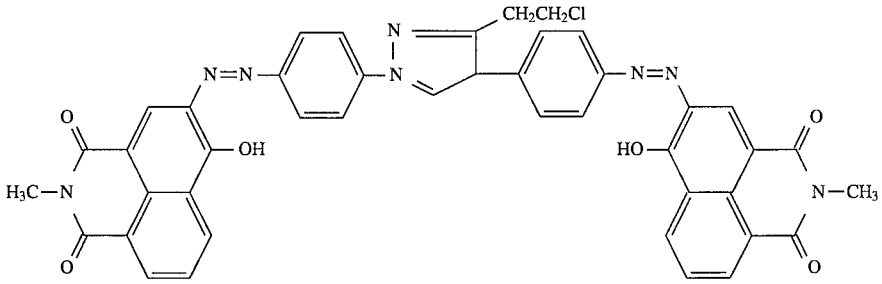

(21)

as an electric charge generating material to obtain a single layer type photosensitive material for analogue light source, which had a single layer photosensitive layer of 15 to 20 μm in film thickness.

Table 5 embodies the phenylenediamine derivative used in these Examples and Comparative Examples by compound number.

The above test (III) of initial electric characteristics was conducted for each photosensitive material to evaluate the characteristics.

The results are summarized in Table 5.

TABLE 5

| | Phenylenediamine derivative | $V_L$ (V) | $E_{1/2}$ (μJ/cm²) |
|---|---|---|---|
| Example 30 | (4) | 206 | 4.18 |
| Example 31 | (5) | 205 | 4.19 |
| Example 32 | (6) | 202 | 4.13 |
| Example 33 | (7) | 203 | 4.12 |
| Example 34 | (8) | 200 | 4.12 |
| Example 35 | (9) | 199 | 4.03 |
| Example 36 | (10) | 204 | 4.09 |
| Example 37 | (11) | 196 | 4.00 |
| Com. Example 7 | (17) | 230 | 4.60 |
| Com. Example 8 | (18) | 235 | 4.63 |

Followings are noted by inspection of Table 5.

Comparative Example 7 using the phenylenediamine derivative (17) which belongs to the m-phenylenediamine derivative of the formula (2) and Comparative Example 8 using the phenylenediamine derivative (18) which belongs to the p-phenylenediamine derivative of the formula (3) have a larger half-life light exposure $E_{1/2}$ (μJ/cm²) and a higher potential after exposure $V_L$ (V), thus being poor in sensitivity.

Examples 30 to 37 using the phenylenediamine derivatives (4) to (11) which belong to the phenylenediamine derivative of the formula (1) have a smaller half-life light exposure $E_{1/2}$ (μJ/cm²) and a lower potential after exposure $V_L$ (V), thus being excellent in sensitivity.

Comparison is made for Examples 30, 31 and 32 using the phenylenediamine derivatives (4), (5) and (6) which belong to the phenylenediamine derivative of the formula (1), wherein the substituents $R^1$ to $R^4$ are alkyl groups, and m, n, p and q are 1 at the same time.

Example 31 using the phenylenediamine derivatives 0 (5), wherein the alkyl groups are substituted with the 4-positions of phenyl groups, has sensitivity equivalent to that of Example 30 using the phenylenediamine derivative (4) wherein the corresponding alkyl groups are substituted with the 3-positions.

Example 32 using the phenylenediamine derivative (6) wherein alkyl groups are substituted with the 4-positions of phenyl groups has sensitivity superior to that of Example 30.

Further, Examples 31 and 32 are compared with Examples 33 and 34 using the phenylenediamine derivatives (7) and (8) which correspond to the phenylenediamine derivative of the formula (1), wherein the substituents $R^1$ to $R^4$ are alkyl groups, m, n, p and q are 2 at the same time, and one of the two alkyl groups substituted with phenyl groups is substituted with the 4-position of the phenyl group.

Example 33 using the phenylenediamine derivative (7) has sensitivity equivalent to that of Example 32, and has sensitivity superior to that of Example 31.

Example 34 using the phenylenediamine derivative (8) has sensitivity superior to that of Examples 31 and 32.

Furthermore, Examples 31 through 34 are compared with Examples 35 and 36 using the phenylenediamine derivatives (9) and (10) which correspond to the phenylenediamine derivative of the formula (1), wherein the substituents $R^1$ and $R^4$ are alkyl groups substituted with the 4-position of phenyl groups, $R^2$ and $R^3$ are aryl groups substituted with the 4-positions of phenyl groups, and m, n, p and q are 1 at the same time; and with Example 37 using the phenylenediamine derivative (11) which corresponds to the phenylenediamine derivative of the formula (1), wherein the substituents $R^1$ to $R^4$ are aryl groups substituted with the 4-positions of phenyl groups, and m, n, p and q are 1 at the same time.

The latter (Examples 35 through 37) has sensitivity superior to that of the former (Examples 31 through 34).

We claim:

1. An electrophotosensitive material comprising an electrophotosensitive layer provided on a conductive substrate, said electrophotosensitive layer is a single layer containing (i) a binding resin, (ii) an electric charge generating material and (iii) an electric charge transferring material, said electric charge transferring material containing a phenylenediamine derivative of the general formula:

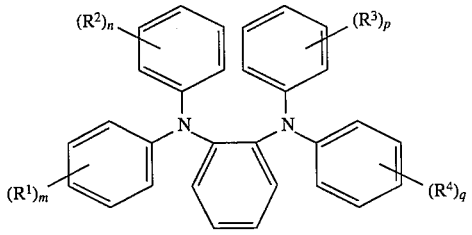

wherein $R^1$ and $R^4$ are the same alkyl group; $R^2$ and $R^3$ are the same alkyl group which is the same as or different from that of $R^1$ and $R^4$; and m, n, p and q are 1 or 2 at the same time.

2. An electrophotosensitive material comprising an electrophotosensitive layer, provided on a conductive substrate, said electrophotosensitive layer is a single photosensitive layer containing (i) a binding resin, (ii) an electric charge generating material and (iii) an electric charge transferring material, said electric charge transferring material containing a phenylenediamine derivative of the general formula:

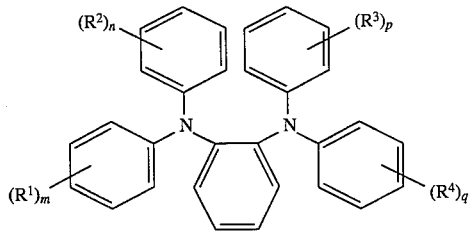

wherein $R^1$ and $R^4$ are the same alkyl or aryl group; $R^2$ and $R^3$ are the same aryl group which is the same as or different from that of $R^1$ and $R^4$; and m, n, p and q are 1 at the same time.

3. An electrophotosensitive material comprising an electrophotosensitive layer, provided on a conductive substrate, said photosensitive layer is a multi-layer electrophotosensitive layer comprising:

an electric charge generating layer containing an electric charge generating material; and an electric charge transferring layer containing a phenylenediamine derivative of the general formula, as an electric charge transferring material:

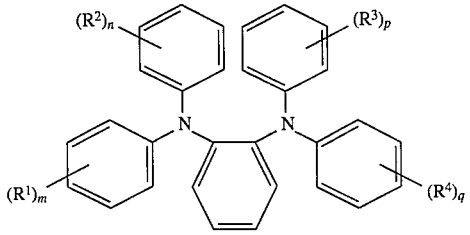

wherein $R^1$ and $R^4$ are the same alkyl group; $R^2$ and $R^3$ are the same alkyl group which is the same as or different from that of $R^1$ and $R^4$; and m, n, p and q are 1 or 2 at the same time.

4. An electrophotosensitive material comprising an electrophotosensitive layer, provided on a conductive substrate, said photosensitive layer is a multi-layer photosensitive layer comprising:

an electric charge generating layer containing an electric charge generating material; and an electric charge transferring layer containing a phenylenediamine derivative of the general formula, as an electric charge transferring material:

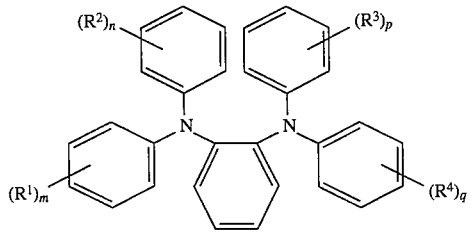

wherein $R^1$ and $R^4$ are the same alkyl or aryl group; $R^2$ and $R^3$ are the same aryl group which is the same as or different from that of $R^1$ and $R^4$; and m, n, p and q are 1 at the same time.

5. An electrophotosensitive material formed from an electric charge generating material and a charge transferring material, said charge transferring material comprising; a phenylenediamine derivative of the general formula (1A):

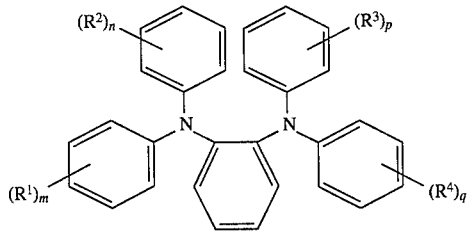

wherein $R^1$ and $R^4$ are the same alkyl group; $R^2$ and $R^3$ are the same alkyl group which is the same as or different from that of $R^1$ and $R^4$; and m, n, p and q are 1 or 2 at the same time.

6. An electrophotosensitive material according to claim 2 where said electric charge generating material is a phthalocyanine pigment.

7. An electrophotosensitive material according to claim 2 where said electric charge generating material is an azo pigment.

8. An electrophotosensitive material according to claim 2 wherein said electric charge generating material is in the amount of 0.1 to 50 parts by weight and said charge transferring material is in the amount of 20 to 500 parts by weight, for 100 parts by weight of said binding resin.

9. An electrophotosensitive material according to claim 4 where said electric charge generating material is a phthalocyanine pigment.

10. An electrophotosensitive material according to claim 4 where said electric charge generating material is an azo pigment.

11. An electrophotosensitive material according to claim 4 further comprising a binding resin and wherein said electric charge generating material is in the amount of 0.1 to 50 parts by weight and said charge transferring material is in the amount of 20 to 500 parts by weight, for 100 parts by weight of said binding resin.

12. An electrophotosensitive material according to claim 1, wherein said electric charge generating material is a phthalocyanine pigment.

13. An electrophotosensitive material according to claim 1, wherein said electric charge generating material is an azo pigment.

14. An electrophotosensitive material according to claim 1, wherein said single layer photosensitive layer contains an electric charge generating material in amount of 0.1 to 50 parts by weight, and contains an electric charge transferring material containing a phenylenediamine derivative of the formula (1) in amount of 20 to 500 parts by weight, for 100 parts by weight of a binding resin.

15. An electrophotosensitive material according to claim 3, wherein said electric charge generating material is a phthalocyanine pigment.

16. An electrophotosensitive material according to claim 3, wherein said multi-layer photosensitive layer is obtained by forming an electric charge generating layer on a conductive substrate and forming an electric charge transferring layer thereon.

17. An electrophotosensitive material according to claim 3, wherein said electric charge transferring layer contains an electric charge transferring material in amount of 10 to 500 parts by weight for 100 parts by weight of a binding resin, said electric charge transferring material containing a phenylenediamine derivative of the formula (1).

* * * * *